United States Patent [19]

Ilfrey et al.

[11] 3,999,617

[45] Dec. 28, 1976

[54] SELF-SUPPORTED DRILLING RISER

[75] Inventors: William T. Ilfrey, Houston; William W. Todd, Shepperton; Richard A. Warriner, Houston, all of Tex.

[73] Assignee: Exxon Production Research Company, Houston, Tex.

[22] Filed: Sept. 29, 1975

[21] Appl. No.: 617,623

[52] U.S. Cl. ..... 175/7; 166/.5

[51] Int. Cl.[2] ..... E21B 15/02

[58] Field of Search ..... 175/5, 7; 166/.5, .6

[56] References Cited

UNITED STATES PATENTS

| | | | |
|---|---|---|---|
| 3,196,958 | 7/1963 | Travers et al. | 166/.5 X |
| 3,307,624 | 3/1967 | Lubinski | 166/.5 |
| 3,330,340 | 7/1967 | Hayes et al. | 166/.6 |
| 3,378,086 | 4/1968 | Kivisild | 175/7 |
| 3,454,116 | 7/1968 | Hunsucker | 175/7 |
| 3,525,388 | 8/1970 | McClintock | 166/.5 |
| 3,705,623 | 12/1972 | van Elk et al. | 166/.6 |
| 3,754,607 | 8/1973 | Van Oaalen | 175/7 |
| 3,782,460 | 1/1974 | Skinner | 166/.5 |
| 3,817,325 | 6/1974 | Mott et al. | 166/.5 |

*Primary Examiner*—Ernest R. Purser
*Assistant Examiner*—Richard E. Favreau
*Attorney, Agent, or Firm*—E. Eugene Thigpen

[57] ABSTRACT

Apparatus and method for drilling a well into a submerged bottom from a floating drilling vessel while employing a riser pipe having positive buoyancy is disclosed. The riser pipe extends between the vessel and the well and is comprised of an upper and a lower section. Means are connected to the lower section for imparting a buoyant force to it of sufficient magnitude to render it positively buoyant. Means are provided extending between the submerged bottom and the upper end of the positively buoyant riser section for restraining the lower section against upward movement. The upper section of the riser pipe may be disconnected from the lower section so that the vessel may abandon the well site. The lower riser section is left self-standing, connected to the wellhead.

14 Claims, 6 Drawing Figures

SELF-SUPPORTED DRILLING RISER

BACKGROUND OF THE INVENTION

1. Field of the Invention

The present invention is directed to apparatus and method for drilling a well into a submerged bottom from a floating drilling vessel with a riser having positive buoyancy.

2. Description of the Prior Art

An increasing amount of drilling is being conducted offshore in an attempt to locate new oil fields. In deep water, exploratory wells are generally drilled from floating vessels. As in onshore operations, drilling fluid must be circulated through the drill bit to keep it cool and carry away drill cuttings. Normally, the drilling fluid is returned from the well to the water surface by means of a large diameter pipe, known as a riser, extending between the vessel and the subsea well. The drill string extends through the riser, and drilling fluid circulates downwardly through the drill string, out through the bit and upwardly through the annular space between the riser and drill string.

As the water depth in which drilling operations are conducted increases, the static weight of the riser becomes so great that it will tend to buckle under its own weight unless supported. In deeper water, tensile force in excess of that required merely to support the weight of the riser must be applied to the riser to prevent forces imparted by waves, currents, and dense drilling fluids from distorting or even buckling the riser pipe. This axial tensile force is normally applied to the riser by means of tensioning devices situated on board the vessel. In very deep water, however, it becomes impractical to provide all of the supporting force from the drilling vessel because of the size and cumbersomeness of the tensioning devices required.

Since the magnitude of tensile force that can practically be developed on the vessel is limited, in very deep water it would be desirable to add enough buoyant material to impart positive buoyancy to the riser. Synthetic foam and other buoyant materials have been attached along the length of the riser for this purpose, but this technique presents problems of its own.

One problem is that, in the event of accidental serverance of the riser or its release from the underwater wellhead, the buoyancy is apt to propel the riser upwardly out of the water, creating the likelihood of damage to property and injury of personnel. Another problem with a positively buoyant riser is that it complicates the procedure required for temporary abandonment of the drilling location if inclement weather forces the drilling vessel to leave the area, making it difficult to move off the drilling site in a short period of time. Accordingly, while a positively buoyant riser offers a number of advantages, the problems accompanying such sytsems have limited there use in the past.

SUMMARY OF THE INVENTION

The present invention is directed to a drilling riser provided with external buoyant material which alleviates the problems outlined above. It is comprised of upper and lower sections, the lower section being detachably connected to the upper section by means of a remotely operable connector. The lower section comprises the major portion of the riser and is provided with buoyant material attached to the riser along the length thereof. Sufficient buoyant material is affixed to the lower section to render it positively buoyant. A plurality of restraining cables extended between the upper end of the lower riser section and the submerged bottom to prevent upward movement of the lower riser section. Lateral restraining means extend between the riser and the restraining cables, restraining lateral movement of the positively buoyant section.

In a preferred embodiment, the restraining cables extend between the surface vessel and the ocean floor and are clamped to a frame member connected to the upper end of the lower riser section. The restraining cables are used for guiding the riser from the surface vessel to the ocean floor. Apertures in the same slidingly receive the cables. Once the riser has been guided into position, clamps within the frame are actuated to restrain further movement of the riser. Thus, upward movement of the riser is prevented should the lower riser section be severed or otherwise released from its connection to the underwater wellhead.

Preferably, shearing means for shearing the drill pipe within the riser are connected to the riser adjacent the connector. If it becomes desirable for the surface vessel to vacate the area above the well site, the connector is operated to release the upper riser section from the lower section. The lower section is left, self-standing, at the well site. If there is insufficient time to withdraw the drill pipe from the riser, it can be severed by the shearing means. The upper rise section and any sheared drill pipe can then be removed with the surface vessel. To facilitate reconnection, the upper ends of the restraining cables may be tied off to buoys so they remain floating at the well site. To resume drilling operations, the buoyed restraining cables are retrieved, and employed for guiding the upper riser and drill pipe section back into position.

A significant advantage of the invention is that the buoyant riser is prevented from projecting itself to the surface, possibly causing damage to the surface vessel and personnel, in the event of accidental severance of the riser or release of the riser from its attachment to the wellhead. Another advantage is that it permits the major portion of the riser to remain attached to the wellhead in a self-standing mode if inclement weather or some other contingency forces the vessel to leave the drilling site. A further advantage is that it permits rapid evacuation from the drilling site by the surface vessel in the event of inclement weather.

DESCRIPTION OF THE PREFERRED EMBODIMENT

Figure 1:
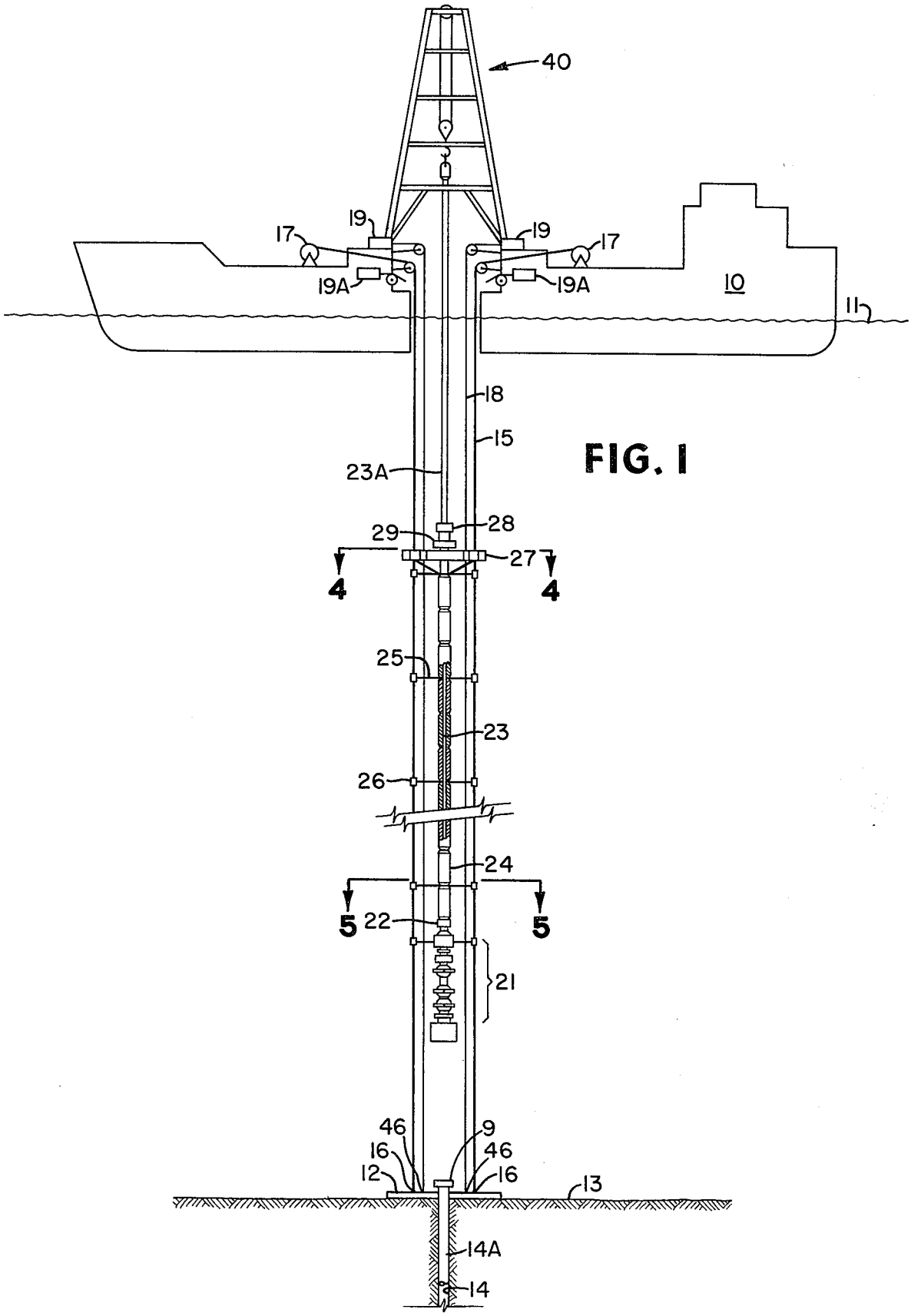
FIG. 1 is a schematic representation of an underwater drilling operation in which a riser, according to the present invention, is shown being lowered into position for a drilling operation.

FIG. 1 shows a drilling vessel 10 floating in a body of water 11. Below the vessel, a wellbore 14 traverses the earth's formations beneath the ocean floor 13. A base plate 12 is positioned atop the wellbore. A string of casting 14A extends through the base plate and into the wellbore and has a wellhead 9 positioned at the top thereof. A drilling riser comprised of an upper section 23A and a lower section 23 is lowered from the drilling vessel to the wellhead.

The riser is assembled by joining a series of tubular members on the vessel and lowering them toward the ocean floor using restraining cables 15 for guidance. To facilitate the lowering operation, retrievable internal weights (not shown) may be releasably attached to the riser pipe.

The four large diameter restraining cables 15 are connected to base plate 12 at locations designated by number 16. The cables extend upwardly to the vessel terminating on constant tension winches 17.

Figure 5:
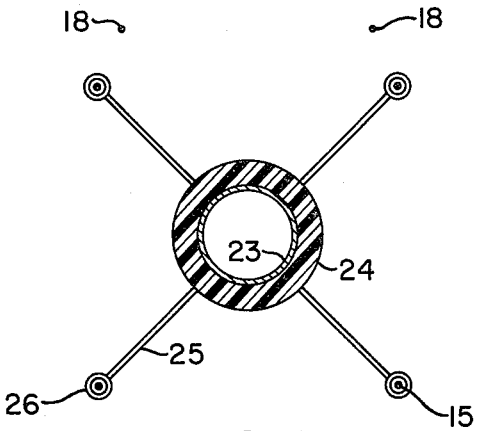
FIG. 5 is a plan view of the riser assembly taken along line 5—5 of FIG. 1, further illustrating the lateral restrain means.

Lateral cables 25 extend between the riser and restraining cables 15 at spaced intervals along the lower portion of the riser. These laterial cables act to provide guidance and lateral support for the riser. As shown in FIG. 5, the lateral cables are attached to restraint cables 15 by means of cylindrical guides 26 that slide freely along the restraint cables.

Cylindrical floats 24 are shown affixed to the tubular members comprising the riser along lower section 23. While cylindrical floats are preferred, it will be appreciated that other types of flotation could also be used. Cumulatively, the floats develop sufficient buoyancy to maintain the lower section of the riser in an upright position when the lower section is left self-standing. Typically, sufficient floats will be affixed to the lower section to develop a buoyant force that will support approximately four times the weight in water of the lower riser section.

Figure 2:
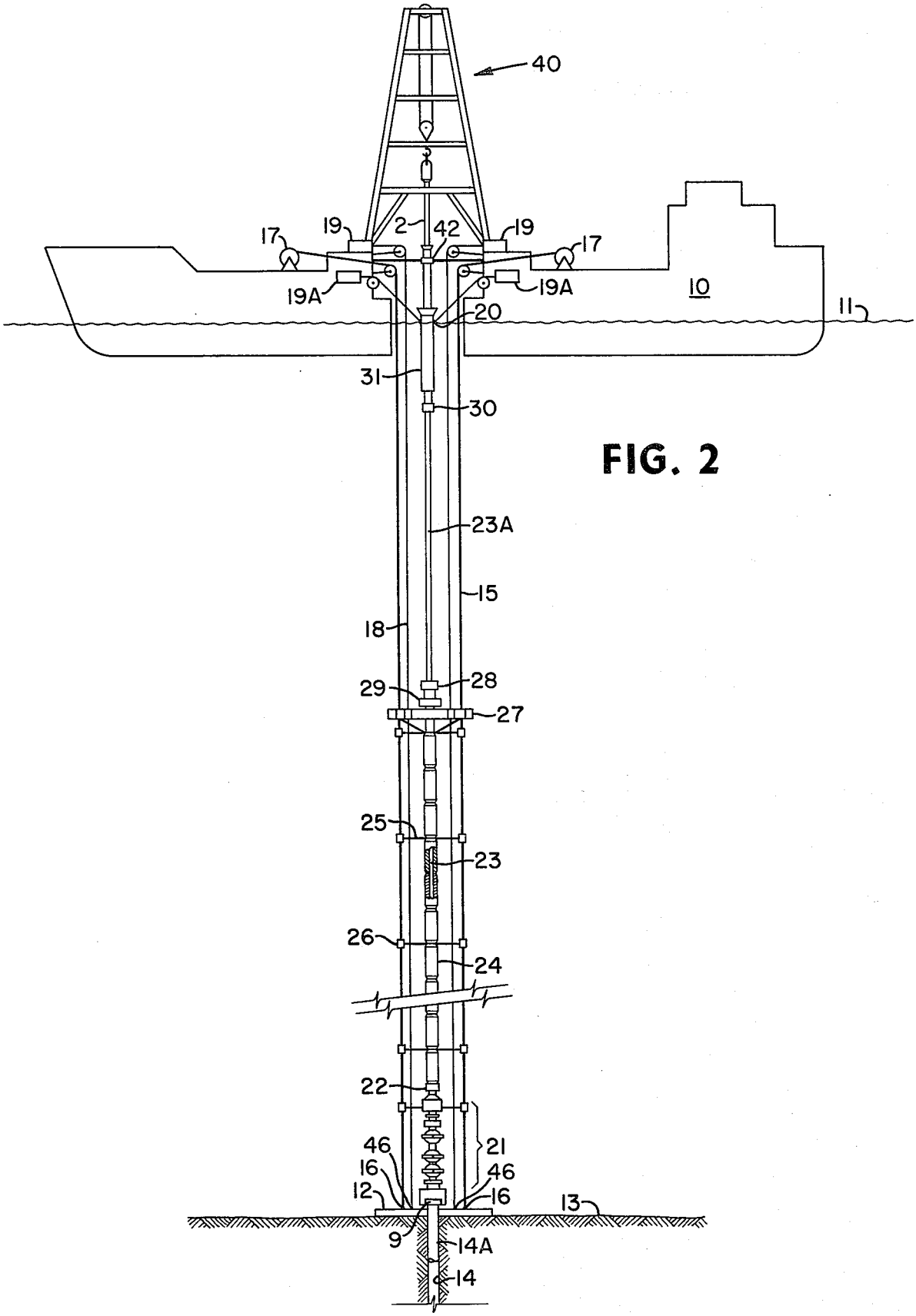
FIG. 2 is a schematic represen tation of an underwater drilling operation in which a riser assembly, in accordance with the present invention, is shown connected to a wellhead.

At the lower end of the riser is a conventional blowout preventer stack (BOP) 21, which is pivotally connected to the lower end of riser 23 by means of ball joint 22. As shown in FIG. 2, the blowout preventer stack is connected to wellhead 9.

The upper riser section 23A upwardly to the lower end of the outer barrel of slip joint 31. Preferably, an upper ball joint 30 is included in the upper riser section just beneath the slip joint. The inner barrel of slip joint 31 is suspended from the vessel by means of a gimballed connection 42. Means for applying constant tension to the riser, designated by numeral 19A, are shown coupled to the outer barrel of slip joint 31 by clamps 20. Constant tensioning means 19A together with the upward force developed by the floats attached to the riser maintain the riser at sufficient tension to prevent forces imparted by waves, currents, and heavy drilling fluids from buckling the riser. A conventional derrick and hoist mechanism designated generally by numeral 40 is provided to handle the drill string 2. The upper riser section 23A and the slip joint outer barrel may be provided with sufficient floats (not shown) to make this portion of the riser neutrally or slightly positively buoyant.

The lower section of the riser 23 is connected to the upper section 23A of the riser by means of a subsea connector 28. This subsea connector is a conventional riser release mechanism, such as the H-4 hydraulic wellhead connector manufactured by Vetco Offshore Industries, Inc., to 250 West Stanley Ave., Ventura, CA., and can be remotely controlled to connect and disconnect the upper and lower sections of the riser.

Figure 6:
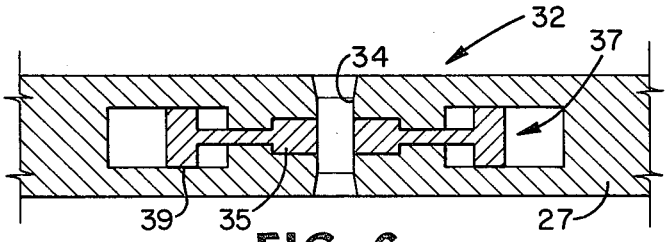
FIG. 6 is a schematic partial view in cross-section taken through a part of the frame.

Positioned on the riser near the top of buoyant lower section is a frame member 27. The system is designed such that when blowout preventer 21 is attached to the wellhead, frame member 27 will be located below the water surface at a sufficient depth, normally 200 to 500 feet, so that the lower section of the riser will not be substantially affected by wave action when it is left self-standing at the drilling site. Frame member 27 is bolted or otherwise securely attached to the riser and contains apertures 34 (see FIG. 4) to slidingly receive restraining cables 15. Frame member 27 includes clamps means which may be similar to apparatus illustrated in FIG. 6. As shown in FIG. 6, clamping means 32 have openings 34 through which restraining cables 15 pass. Gripping blocks 35, positioned on opposite sides of the openings 34, and each connected to a piston 39, are hydraulically actuated by piston and cylinder means 37 to clamp the cables 15 to frame member 27. Although this detail is not shown, clamping means 37 are preferably configured to fail safe i.e. to remain locked in the event of hydraulic failure.

Located near the subsea connector is a shear ram 29, which may be a conventional blowout preventer that can be remotely actuated to shear off the drill string within the riser.

Hydraulic cables or steel lines which may be integral with the riser sections, supply hydraulic fluids from the surface vessel to subsea connector 28, shear ram 29, and frame member 27. Alternatively, one or more separate electro-hydraulic umbilicals may extend between the vessel and frame member 27 to perform control functions.

Figure 4:
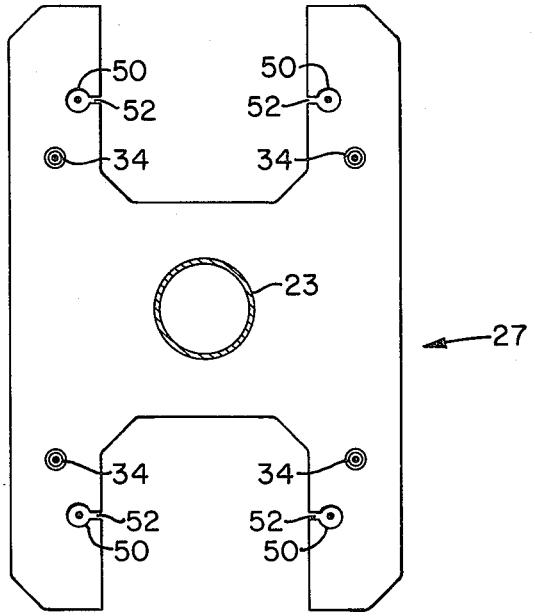
FIG. 4 is a plan view of the frame taken along line 4—4 of FIG. 1.

A set of four standard sized guidelines 18 are also connected between the base plate 12 at locations designated by number 46 and tensioning and spooling mechanisms 19 on the surface vessel. They may preferably be situated outboard of the restraining lines and fit within the apertures 50 of frame member 27 as shown in FIG. 4. The frame member contains slotted openings 52 from apertures 50 to the exterior of the frame to permit a TV camera and BOP control pods to be run on the guidelines between the surface vessel and the location of the wellhead.

Once the frame is secured to restraining cables 15, the restraining cables, now securely connected between the base plate 12 and the frame member 27, will prevent upward movement of the lower riser section 23 if the riser is severed at a point below the frame member 27. Lateral cables 25 restrain the lower riser section lateral movement. Constant tensioning means 19A, which supply the tension for supporting the upper section of the riser pipe 23A, pay in and out to accommodate vertical motion of the drilling vessel caused by waves.

The portions of cables 15 between the frame and vessel are then slacked sufficiently to accommodate vessel heave. The brakes on winches 17, tensioning and spooling mechanism 19, and on the umbilical reels (not shown) are set to slip at a tension less than cable breaking strength, and will allow the cables to spool off completely if the vessel is unexpectedely forced away from the drilling location. Buoys (not shown) are slidably connected to cables 15, cables 18, and the umbilical cables so they will float at the water surface if they spool out.

When it becomes necessary for the drilling vessel to temporarily leave the drilling location, the following sequence of operations is normally conducted. If time permits, the drill string is withdrawn from the riser. If not, the location of the drill string tool joint nearest the subsea BOP is determined by closing the upper annular preventer within the BOP and retracting the drill string until resistance to upward movement of the drill string indicates a tool joint is abutting this annular preventer. The BOP pipe rams are then closed and the tool joint set down on them. With the drill string supported by the pipe rams, the shear-blind ram in the BOP, which is situated above the pipe rams, is then hydraulically actuated to shear the drill string and seal the well.

From knowledge of the length of the lower section of the riser pipe and of the length of the drill string segments, the location of the drill string tool joint nearest the upper shear ram 29 is determined, and if necessary the drill string is moved so that no tool joint is located within the upper shear ram. (Preferably, the lower riser section is structured so that no tool joint can be within the upper shear ram when a tool joint is supported by the BOP rams). Shear ram 29 is then hydraulically actuated to shear the drill string. The subsea connector 28 is released, thereby separating the upper section of the riser from the lower section. Heavy drilling fluids remain within the lower section of the riser, reducing the pressure differential across the closed blowout preventer 21.

Figure 3:
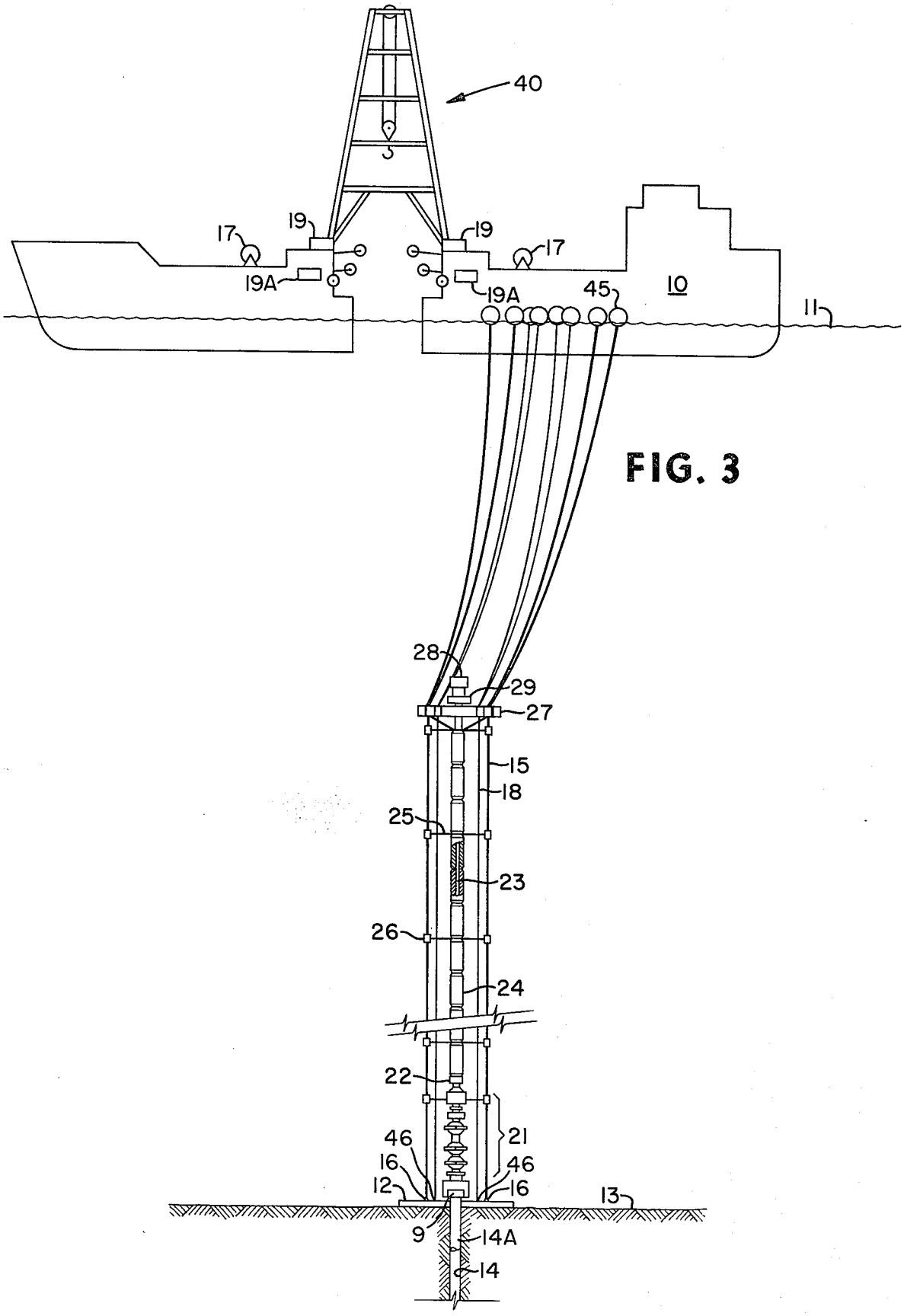
FIG. 3 is a schematic representation of an underwater drilling operation wherein the drilling vessel is shown vacating the drilling site, leaving the lower riser section self-standing, connected to the wellhead.

The brakes on constant tension winches 17, tensioning and spooling mechanisms 19, and the umbilical reels are set to slip and, as shown in FIG. 3, the cables are allowed to reel off and are left attached to floating buoys 45 at the drilling location. The upper riser section and the enclosed drill string are retracted and moved with the vessel, leaving the lower section of the riser in a self-standing mode.

To resume drilling operations, the cables that were left buoyed off are retrieved, and cables 15 are used to guide the upper riser section and drill pipe back to the point of disconnect. Normally, the riser will be equipped with a retrievable TV to assist in rerunning, reorienting, and reconnecting the riser assembly.

In the event inclement weather forces the ship from its mooring location before the normal abandonment procedure, as outlined above, can be followed, subsea connector 28 should be released as quickly as possible to minimize damage to the riser system. As the ship is forced from the drilling location, the brakes on winches 17, spooling and tensioning means 19, and the umbilical reels will slip, permitting the cables to reel out. Upper riser section 23A and the outer barrel of slip joint 31 will assume the configuration of the drill string. If the drill string is still manipulable, the procedure described above for sealing the well, shearing the drill string, and retracting the upper riser section and drill string will be followed.

If the drill string can not be retracted for the purpose of locating the drill string tool joint nearest the BOP, an estimate of the tool joint locations nearest the BOP shear-blind and shear ram 29 can be made based on knowledge of the water depth, the length of drill pipe segments, and the location of shear ram 29. If the estimate places the tool joint locations outside the BOP shear-blind and shear ram 29, the drill pipe can be sheared as described previously. If it is estimated that a tool joint is located within the BOP shear-blind or shear ram 29, tension on the drill string can be slacked off to permit gravity to pull the drill string downwardly to clear the tool out of the BOP shear-blind or shear ram 29. After the drill pipe has been sheared and the well sealed, the upper section of drill pipe and enclosed drill string are retracted and removed with the surface vessel as described above.

We claim:

1. A riser pipe assembly for use in drilling a well into a submerged bottom from a floating vessel, comprising:

a riser pipe extending between said vessel and said well, said riser pipe having an upper section and a lower section;

connector means for releasably connecting the lower section of said riser to the upper section of said riser;

buoyancy means attached to the lower section of said riser having sufficient buoyancy to make the lower section of said riser positively buoyant;

cable means extending between said submerged bottom and the upper end of said lower section of said riser pipe;

means for fastening said cable means to said riser pipe near the upper end of the lower section thereof to restrain vertical movement of said riser pipe relative to said cable means;

lateral restraint means attached to the lower section of said riser pipe at spaced intervals along the length thereof and coupling said riser pipe to said cable means to restrain lateral movement of said riser pipe relative to said cable means.

2. The apparatus of claim 1 wherein said connector is remotely operable.

3. The apparatus of claim 1 wherein said buoyancy means attached to the lower section of said riser pipe is sufficient buoyancy to support approximately four times the weight of the lower section of said riser pipe in the water.

4. The apparatus of claim 1 wherein said means for connecting said cable means to said riser pipe at the upper end of the lower section thereof comprises frame means connected to the lower section of said riser pipe near the upper end thereof, said frame having holes to slidingly receive said cable means and clamping means for clamping said cables to said frame.

5. The apparatus of claim 4 further including shear means in said riser pipe adjacent said connector means for shearing pipe within said riser pipe.

6. The apparatus of claim 5 wherein said lateral support means comprises cable sections attached at one end to said riser pipe at spaced apart locations along the length thereof, and attached at the other end to sleeve members, said sleeve members being slidably received by said cable means.

7. The apparatus of claim 6 further including:

a telescopic slip joint having an outer barrel coupled to the upper end of the upper section of said riser pipe;

constant tension means for coupling said outer barrel of said telescopic slip joint to said vessel.

8. In a riser pipe assembly for use in drilling a well into a submerged bottom from a floating vessel, the improvement comprising:

a riser pipe extending between said vessel and said submerged bottom;

buoyancy means connected to a span of said riser pipe; said buoyancy means imparting a sufficient buoyant force to said span of riser pipe to render it positively buoyant;

cable means fastened to the submerged bottom and to said riser pipe above said span of said riser pipe to restrain said span of riser pipe against upward movement;

lateral restraint means connected to said riser pipe at spaced-apart locations along the length thereof, said lateral restraint means coupling said riser pipe to said cable means to restrain said riser pipe against lateral movement relative to said cable means.

9. In a method for installing a riser pipe between an underwater well and a surface vessel, the improvement comprising:

interconnecting the lower section and the upper section of the riser pipe with a connector that can be selectively parted so that the upper section of the riser can be removed from the drilling location, leaving the lower section in place;

supporting the lower section of the riser pipe with buoyancy means disposed along the length thereof, said buoyancy means making the lower section of said riser pipe positively buoyant;

restraining said lower section of said riser pipe against upward movement by means of at least one elongated tension member connected between the location of the underwater well and the upper end of said lower section of said riser pipe;

restraining said lower section of said riser pipe against lateral movement relative to said elongated tension member by means connected to said lower section of said riser pipe at spaced apart locations along the length thereof and coupling said riser pipe to said elongated tension member.

10. The method of claim 9 wherein said buoyancy means disposed along the length of the lower section of riser pipe is of sufficient buoyancy to support approximately four times the weight of said lower section of riser pipe in the water.

11. The method of claim 9 further including the steps of:

attaching a frame to said riser pipe assembly near the upper end of the lower section thereof;

connecting said elongated tension member to said frame.

12. A method for installing a riser pipe between a surface vessel and a well on a submerged bottom, comprising:

interconnecting the lower section of said riser pipe with the upper section of said riser pipe by means of a connector that can be selectively parted to separate said upper section from said lower section;

installing a shear ram in said riser pipe near said connector;

connecting a frame member to the upper end of the lower section of said riser pipe, said frame member having holes to slidingly receive a plurality of restraint cables;

connecting said restraint cables to said well on a submerged bottom, said cables extending from said well to said surface vessel;

guiding said riser pipe to said well utilizing said restraint cables and connecting said riser pipe to a wellhead positioned atop said well;

supporting the lower section of the riser pipe with buoyancy means disposed along the length thereof, said buoyancy means making the lower section of said riser pipe positively buoyant;

securing said restraint cables to said frame to restrain the lower section of said riser pipe from vertical movement; and applying substantially constant tension to said riser pipe at said surface vessel to maintain the upper section of said riser pipe in tension.

13. The method of claim 12 further including the steps:

of connecting a blowout preventer to the lower end of said riser pipe, said blowout preventer interconnecting said riser pipe and said well; and inserting a drill string through said riser pipe.

14. The method of claim 13 further including the following steps preliminary to vacating the drill site by said surface vessel:

severing said drill string with said shear ram in said riser pipe near said connector;

parting said connector so as to disconnect said upper section of said riser pipe from said lower section of said riser pipe;

retracting said upper section of said riser pipe and the portion of said drill string enclosed therein.

* * * * *